United States Patent [19]

Rowe

[11] Patent Number: 4,802,279

[45] Date of Patent: Feb. 7, 1989

[54] GAME HUNTING KNIFE

[75] Inventor: Jerry D. Rowe, Lander, Wyo.

[73] Assignee: Rocky Mountain Enterprises, Inc., Lander, Wyo.

[21] Appl. No.: 40,268

[22] Filed: Apr. 17, 1987

[51] Int. Cl.[4] ..... B26B 3/04

[52] U.S. Cl. ..... 30/155; 30/151

[58] Field of Search ..... 30/161, 162, 151, 155, 30/156, 157

[56] References Cited

U.S. PATENT DOCUMENTS

| | | | |
|---|---|---|---|
| 2,051,721 | 8/1936 | Kirangelos | 30/156 |
| 2,596,294 | 5/1952 | Schrade | 30/161 |
| 2,628,423 | 2/1953 | Cuntz | 30/156 |
| 2,810,194 | 10/1957 | Unsingen | 30/155 |

*Primary Examiner*—Frank T. Yost
*Assistant Examiner*—Willmon Fridie, Jr.
*Attorney, Agent, or Firm*—Andrus, Sceales, Starke & Sawall

[57] ABSTRACT

A game hunter's knife has a folding blade unit movable to an enviscerating cut or alternatively a skinning position. The knife includes an elongated blade pivoted in one end of a handle having a through slot for moving the blade to the opposite sides. An enviscerating guard is pivoted to one side of the handle and is pivoted 90° with the blade abutting the guard to form a hook for convenient cutting of the animal hide by a pulling action. The guard separates the entrails and meat from the skin during cutting. The blade is pivoted to the opposite side of the handle for skinned with the guard abutting the handle. The guard includes a small opposite projection extending the pivot to form a stop for the blade extending longitudinally outwardly of the handle in position for skinning.

13 Claims, 1 Drawing Sheet

GAME HUNTING KNIFE

BACKGROUND OF THE PRESENT INVENTION

This invention relates to a game hunting knife especially constructed for vescuating of game animals and particularly to a dual-action knife for eviscerating and skinning of game animals.

Game animals should be at least partially dressed immediately after the kill of the animal. The dressing is necessary to maintain the meat in an optimal edible condition. This requires cutting into the animal and removal of the inner non-edible entail and other elements. Conventionally, a single bladed hunting knife has been used to open the belly of the animal from the crotch to the rib cage. The knife is preferably introduced into the animal to cut the skin from the inside out in order to minimize severing of the entails and introducing of hair and other foreign matter into the innards of the animal and thereby minimize contamination of the meat. It is of course quite important that the animal entrails and particularly the sock enclosing most of the entrails not be opened as a result of the cutting operation. As discussed in U.S. Pat. No. 3,839,788 which issued on Oct. 8, 1974, deer and other large animals are particularly difficult to dress in the field because the toughness of the hide makes it difficult to cut the animal open without contaminating the meat, and resulting in tainted meat. Even with a sharp knife it is often quite difficult for the average hunter to open a deer or other large animal with the necessary degree of accuracy.

Various suggestions have been made for a provision of a special knife for opening of game animals. The above '788 patent for example discloses a special multiple part knife having a generally U-shaped hook blade arrangement for eviscerating of large game animals. The V-shaped cutting edge is located inside of the U-shaped blade construction and is adapted after insertion to be pulled through the animal hide to sever the hide. The outer side of the U-shaped blade construction serves to guide and separate the skin from the innards of the animal thereby minimizing the danger of actually severing the animals innards. The pulling and inverted arrangement of the blade results in cutting from the inside out thereby minimizing the introduction of hair and foreign matter into the animal. The above patent also discloses multiple cutting blades with a second blade extending outwardly from the handle structure to provide for a more or less conventional forwardly projecting blade. The extended blade is desirable for skinning of the animal, wherein the skin is laid back and separated from the meat. The multiple blade unit of course requires separation of the knife structure for enclosing of the blades within the handle structure. The storing of the blades within the handle is of course desirable to avoid accidental engagement with the sharp cutting edges during storage and particularly while carrying the knife unit in the woods. The above structure does of course requires the opening and assembly of the knife structure in the woods, and often under severe environmental conditions such as cold, snow and the like. A similar eviscerating knife is shown in U.S. Pat. No. 2,906,021 which issued on Sept. 29, 1959. The latter patent discloses a single purpose U-shaped eviscerating knife, with an exposed blade. Generally, one would store the knife in a separate storage casing to avoid damaging or injury while carrying of the knife. The latter patent also discloses a generally conventional folding knife. The outer end of the handle is formed with a pivotal end movable from a closed protective position outwardly to form a jaw-like portion to permit an inside out cut with the tip portion of the blade.

The prior art solutions minimize the cutting of the innards of the animal while providing for opening of the animal as well as skinning of the animal.

Generally, the prior art as known to applicant has certain disadvantages, such as cost, inconvenient usage of the knife in the field and special storage requirement. There is a need for a highly safe and effective game hunter's knife which is conveniently used, stored and carried, and which of course can be constructed without undue cost.

SUMMARY OF THE PRESENT INVENTION

The present invention is particularly directed to an improved eviscerating game hunter's knife, and in a optimum and particularly unique construction is directed to a dual functioning game hunter's knife having a folding blade unit which can be positioned in one position for optimum eviscerating cuts and alternately in a second position for skinning or like cuts.

Generally, in accordance with the present invention, the game hunter's hunting knife is constructed with a handle for operating of the knife, with a folding blade and a folding eviscerating back guard constructed and arranged which permits orientation of the blade and the eviscerating guard with respect to the handle to provide for an optimal eviscerating inside-out cut. For the dual functional game knife embodiment, the pivotal blade has an alternate position with the blade projecting outwardly in a skinning position.

More particularly in one embodiment of the invention, the handle is constructed for convenient grasping in the hand of the hunter or other user. An elongated blade is pivotally mounted in one end of the handle, which is provided with a through opening or slot permitting the orientation of the blade to the opposite sides of the handle. The blade has at least one sharp edge. The eviscerating guard is pivotally secured to the handle is and pivotal to one side of the handle with the blade. The guard is located opposite the particular eviscerating cutting edge of the blade. The blade and guard is pivoted outwardly, preferably substantially to about 45°. The blade is then located for convenient cutting of the animal hide by a pulling action, with the eviscerating guard separating the entrails and meat from the skin during the cutting operation and thereby providing optimal severing. The handle provides a completely satisfactory handle for exerting the necessary pulling force. The handle may of course be constructed in any suitable manner to permit the holding required for convenient and reliable cutting of the hide. In the dual cutting action hunting knife, the blade slot or opening permits rotating the blade from the storage position to the opposite side of the handle from that used for the eviscerating cut. The guard is folded to abut the handle and includes an outer projection extending outwardly from the pivot end of the knife. In the skinning position, the blade is rotated to the opposite side, to generally extend longitudinally outwardly of the handle. The extended end of the guard serves as a back support and stop for the blade in the extended position. The extended portion of the guard thus locates and firmly holds the blade in position for cutting during skinning and other like conventional knife functions.

More particularly in a preferred embodiment of the dual action hunting knife, the handle is formed as an elongated and geneally flat handle somewhat longer than the width of the conventional hunter's hand. The one end of the knife handle is formed with a lateral through-slot. The handle may conveniently be formed with conventionally curved serpentine opposites long side edges providing for recesses within which the user's fingers are conveniently located for firm grasping of the handle. The blade and separator or eviscerating cover are rotatably pinned within the outermost end of the blade handle and slot. The blade is formed with a single cutting edge and of a length to pass through and within the slot from either side of the handle. The blade is preferably formed with a conventional tapered knife construction having a single cutting edge which curves and tapers to a sharp point. The eviscerating cover or separator is formed of a thickness generally corresponding to that of the handle and is formed with a generally curved configuration from the pivot point beyond the tip of the blade. The cover includes an inner recess within which the back edge of the blade fits with the tip of the blade located within the recess. Thus with the cover and the blade pivoted outwardly, and with the blade in the nested position, the main cutting edge of the blade is exposed facing inwardly toward the handle to provide the inside-out cut blade.

The outer cover includes am integral oppositely extending portion which curves in a somewhat opposite direction for a short distance. The extension is of a substantially shorter length than the length of the cutting blade. The extension includes an inner edge recess adapted to mate with the back edge of the blade immediately adjacent to the pivot location. With the blade pivoted outwardly in the opposite direction from the eviscerating position, the blade is in the skinning or more conventional knife position and engages the recess of the extension. The cover abutts the side of the knife handle for appropriately locating of the blade for skinning or the like. The cover is of course conveniently grasped and pivoted to the desired position. The knife blade is preferably formed with a knurled enlargement at the pivot position for appropriately rotating of the knife to the desired alternate position operative positions. The cover may move to the desired position upon the rotating of the blade.

In the folded carrying position, the knife blade is held within the pass-through slot to firmly and reliably protect the knife blade, permitting safe and reliable storage and carrying of the knife. Third, the knife is readily positioned in the desired cutting position.

The present invention thus provides a relatively simple folded knife construction which may be readily constructed as a multiple functioning hunting knife with the single blade movable between the alternate eviscerating position and skinning position. The knife construction is readily adapted to more or less to conventional mass production using readily available and constructed elements and components.

BRIEF DESCRIPTION OF DRAWING

The drawing furnished herewith further illustrates a preferred construction of the present invention in which the above features and advantages as well as others are clearly disclosed.

In the drawing.

DESCRIPTION OF ILLUSTRATED EMBODIMENT

Figure 1:
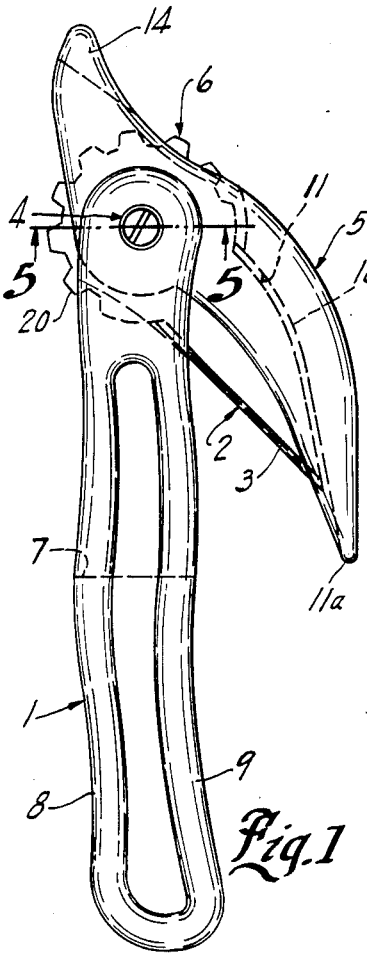
FIG. 1 is a plan view of the dual action hunting knife with the blade located in the eviscerating position.
Figure 2:
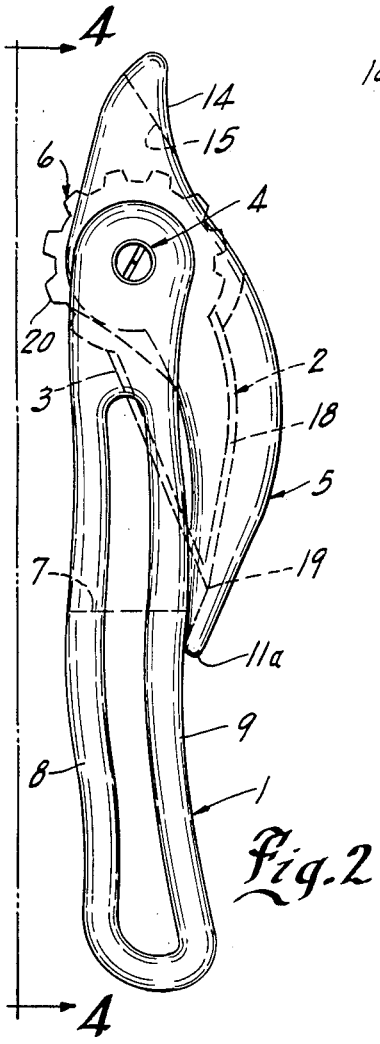
FIG. 2 is a plan view with the knife of FIG. 1 in the folded storage and carrying position.

Referring to the drawing and particularly to FIG. 1 the illustrated hunting knife includes an elongated hand-held handle 1. A double edged blade 2 has a first cutting edge 3 extending throughout substantially one edge of the knife blade 2. The blade 2 is pivotally secured to one outer end of the handle as at 4. A back-edge blade cover or shield 5 is pivotally secured to the handle 1 with the blade 2 and extends outwardly over the back edge of the blade 2. In one pivoted position, shown in FIG. 1, the blade 2 and cover 5 are shown projected outwardly at an angle to the handle 1, with the cutting edge 3 facing toward handle 1. FIG. 1 thus illustrate the knife in an inside-out cutting arrangement for opening of an animal by severing of the hide. The shield 5 is located inwardly within the animal and protects the animals innards from the blade 2 proper, and minimizes and essentially prevents actual opening and distruction of the innards. The blade 2 is formed at the pivot unit 4 with an enlarged knurled portion 6 permitting the pivoting of the blade 2 from the position of FIG. 1 toward the handle 1. A through-slot 7 is formed in the handle 1. The through-slot 7 extends from the pivot unit 4 for a length somewhat slightly greater than the length of total length of the cutting blade 2 and extends from the opposite side edges 8 and 9 of the handle 1. Thus, the blade 2 which may be pivoted inwardly within the slot 7 to a protected position as shown in FIG. 2. The outer shield 5 is folded to abut the adjacent edge 9 of the knife to provide a compact pivoted knife unit for storage carrying and the like.

The blade 2 is also adapted to be pivoted from the opposite outer edge 8 of the slot 7, with the cover 5 in the folded position. In the alternate position, the blade 2 projects outwardly from the pivot unit 4 with the knife back edge of the blade abutting a short, extended portion 9*a* of the cover 5 as shown in FIG. 3.

The width of the handle 1, at least in the area of the slot 7 of a sufficient width to receive the blade 2 and completely confines the blade within the handle 1 during storage carrying and the like, for example, as shown in the dotted outline in FIG. 2. The blade 2 is held in the storage position as well as in the alternate position in any desired manner, such as by a conventional latch or pressure fit. In the functioning or cutting positions, the cover 5 may function as a stop to positively limit and position the blade in the alternate functioning location against the cutting forces created by the use of the knife.

Figure 3:
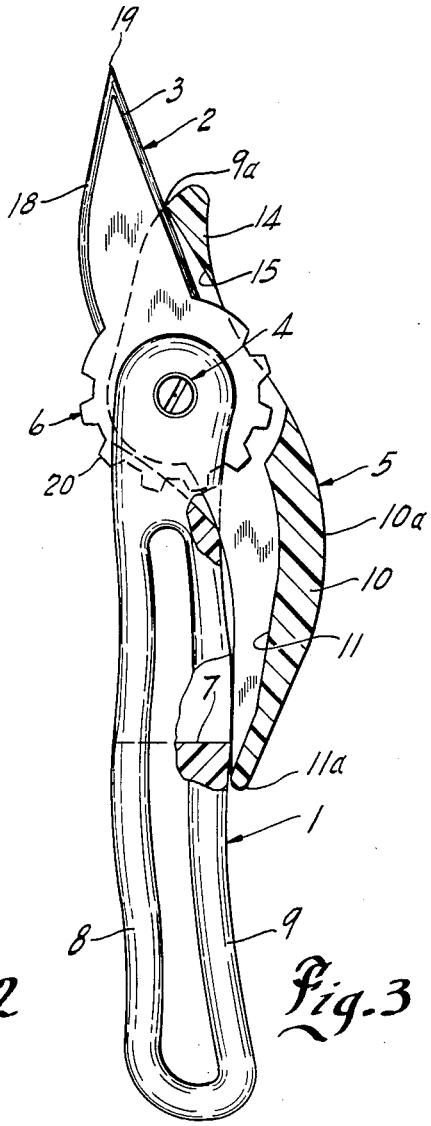
FIG. 3 is a plan view of the knife of FIGS. 1 and 2 showing the knife blade in the skinning position.
Figure 5:
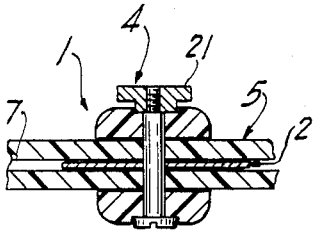
FIG. 5 is a vertical section taken generally on line 5—5 of FIG. 1.
Figure 4:
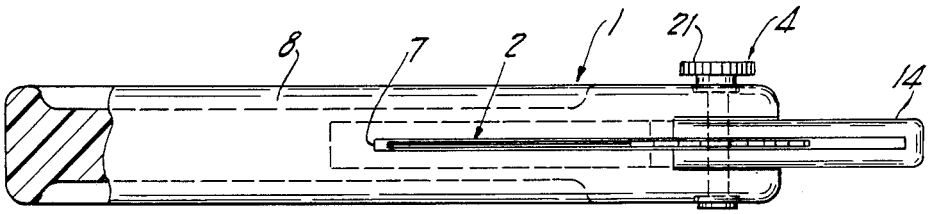
FIG. 4 is a longitudinal edge view and taken along line 4—4 of FIG. 2.

In summary, as shown in FIGS. 1 through 3, the knife unit is adapted to be a folded knife unit with the knife blade protected, and alternately and selectively the blade 2 may be rotated into either of the eviscerating position of FIG. 1 or the skinning position of FIG. 3 with the cutting edge 3 of the blade appropriate exposed and oriented for the desired functioning.

More particularly, the shield 5 includes a blade cover portion 10 of a length somewhat greater than the length of the blade 2. The thickness of the shield 5 is greater than the thickness of the cutting blade and generally will be formed of a thickness corresponding to that of the handle 1. The outer edge 10*a* of the shield 5 is formed as a continuous and smooth curved outer edge. The edge 10*a* not only curves smoothly from the pivot location outwardly beyond the tip of the blade but also has smooth curved side edges merging with the sides of the shield 5. The shield 5 also includes an inner slot or recess 11 of a thickness generally corresponding to the thickness of the back portion of the blade 2. The recess 11 is of a sufficient depth to telescope and receive the back edge of the blade knife 2 with the cutting edge in the eviscerating position exposed and to completely cover the outermost pointed end of the knife blade, as shown in FIG. 1. In the position of FIG. 1, the cutting edge is exposed inwardly throughout a partial length of the cover and generally provides a continuous expose cutting edge which terminates within and inwardly of the outermost end of the cover. The curved cover includes an outer curved tip portion 11*a* extending from the exposed cutting edge 3 of blade 2. The reverse portion is again formed as a smooth curved surface, having side edges with merges with the side walls and opposite edge of the cover or shield. The smooth curved back edge and extended portion which extends outwardly and longitudinally of the blade 2 will serve to engage the inner portions of the animal and move such portions inwardly and away from the skin before the blade 3 reaches the previously engaged portion of the skin.

The shield 5 has an enlarged circular portion at the pivot unit 4 between or within the slot 7 of the knife handle. The pivot unit passes between the handle and particularly the enlarged circular portion of the shield 5 and the knurled portion 6 of the knife blade 2 to pivotally support the cover.

A smooth, curved portion 14 of the shield 5 projects in the opposite direction of the handle 1 from that of the blade cover portion 10. The extension portion 14 curves outwardly with an inner edge curving outwardly from the handle in a direction generally opposite of the cover portion. The length of the extension 14 is only a portion of the length of the blade 2 and generally is shown as approximately ⅓ of the length of the blade. The reverse curved portion 14 includes an inner edge recess 15 extending throughout the length thereof and of a width generally corresponding to the thickness of the back portion of the blade 2 adjacent the pivot unit 4, and adapted to receive the blade in the skinning position shown in FIG. 3.

The illustrated cutting blade 2 is shown as a more or less conventional knife blade having the circular pivot portion 6 at the pivot unit 4. The blade 2 is formed with a smewhat generally curved back edge 18 extending from the circular portion 6 outwardly to a sharp outer point 19 with edge 3. The curved cutting edge 3 of the blade 2 extends outwardly from the circular portion 6 in a substantially curved manner with the outer end portion extending as a straight portion to the sharp point formed with the edge 3. The enlarged circular portion 6 at the pivot unit 4 has an outer knurled edge 20 for convenient pivoting of the knife within the pivot unit 4.

The illustrated pivot unit 4 is formed as a simple pin type pivot with a pivot bolt and nut unit extending through the handle 1, the shield 5 and the blade 2. Suitable lock washers are located within the pivot unit to provide an engagement and preferred pressure lock of the blade in the desired position, and a locking nut 21 provided for locking in the plate and shield in place.

The present invention provides a significantly practical hunting knife for immediate partial dressing of an animal in the field, and such a knife may be conveniently constructed with existing technology.

Although the knife has been developed for hunters of game animals, the knife may of course be used in other applications particularly where a pulling action is desired and the protected blade provides the desired orientation. The knife would be useful as part of a survival and/or emergency unit. For example, the knife provides an excellent cutter for cutting seat belts and similar restraining straps and tie-downs in vehicles in an emergency. The knife can be readily constructed as a compact and light weight unit for use by travelers, airborne survival vests and the like.

Various modes of carrying out the invention are contemplated as being within the scope of the following claims particularly pointing out and distinctly claiming the subject matter which is regarded as the invention.

I claim:

1. A knife, comprising an elongated handle, a cutting blade, a pivot unit connected to said handle and said blade and pivotally supporting said blade to one end of said handle, said handle having a slot extending from said pivot unit for a length exceeding the length of said blade, a shield means coupled to said pivot unit and pivoted to said handle for movement in the path of said blade, said shield having a length greater than said blade and pivotal between a first position abutting said handle with said blade in said slot and a second position pivotally outwardly and angulated relationship to said handle at a angle no greater than 45° and defining a back support for said blade whereby said blade is pivotal outwardly into engagement with said shield with said cutting edge facing said handle for eviscerate cutting of an animal.

2. The knife of claim 1 wherein said knife blade in said second position is located at an angle no greater than 45°.

3. The knife of claim 1 wherein said shield and handle are constructed and arranged to enclose said cutting blade in a closed folded position of said knife with said shield abutting the side of said handle.

4. The knife of claim 1 wherein said blade includes an enlarged portion projecting outwardly of said pivot unit to expose said enlarged portion and defining a manually engagable blade portion for pivoting thereof.

5. The knife of claim 4 wherein said enlargement means includes a circular enlargement projecting outwardly of said knife handle, said circular portion having a knurled outer edge for increasing the frictional forces established by finger engagement with said edge.

6. The knife of claim 1 wherein said slot is a through slot permitting opposite pivoting of said blade, said blade having cutting edges on both edges of said blade, and said shield means includes a stop portion extending in the opposite direction from said pivot unit, said stop portion of said shield being substantially shorter than said blade and constituting a back support with said blade pivoted outwardly of said handle into essential alignment with said handle to expose the outermost end of said blade and the cutting edge of said blade as a generally in-line extension of said handle.

7. A knife adapted to sever a first element having a second element abutting the first element, comprising a handle, a blade secured to said handle and adapted to be positioned between a protective positon within said handle for protective enclosure and extending outwardly at an angle from said handle in a cutting position, said blade in said cutting position having a curved cutting edge facing said handle, a back shield movably secured to said handle and movable between a position abutting said handle with said blade in said protective position and a cutting position abutting the back edge of said knife in said cutting position, said shield extending over the outermost end of said knife blade and having a smooth curved outer surface extending along the back side of said blade and an extension portion extending beyond the outermost end of said blade, and said extension portion adapted to project between the first element being cut and the abutting second element abutting said first element and operable to move said second element from said cutting edge and the first element being cut to prevent interengagement of the blade with said second element.

8. The knife of claim 7 wherein said shield has a serpentine configuration including an outwardly flared portion extending from the outermost end of said cutting blade in said cutting position and with said shield abutting the outer edge of said blade.

9. The knife of claim 7 wherein said shield includes an edge slot aligned with and receiving the outer edge of said blade in siad cutting position.

10. The knife of claim 7 wherein said blade is pivoted to a 90° position relative to said handle in said cutting position.

11. The knife of claim 7 wherein said blade includes a circular portion at said pivot unit having a knurled-like outer edge for increasing the frictional forces established by finger engagement with said outer edge for rotating of said blade and shield.

12. A folding knife, comprising an elongated handle adapted to be hand held for cutting, said handle having a through-slot extending through said handle, and elongated cutting blade of a length less than the length of said handle through-slot, a pivot means pivotally securing one end portion of said blade to said handle with the blade aligned with said slot and movable therethrough, said blade having opposite cutting edges extending along the opposite blade edges outwardly of said pivot unit and extending in opposite direction of said pivot unit, said cutting edges being exposed upon movement of said blade from said slot, a shield member secured to said pivot unit and located abutting one cutting edge upon pivoting of said blade from said slot with the opposite cutting edge exposed in position for cutting, and said shield member being movable into abutting engagement with said handle.

13. A hunting knife for in-field dressing of killed animals comprising, an elongated handle adapted to be grasped by the hunter's hand, a cutting blade having a elongated cutting edge terminating in a curved end at one end and having an enlarged circular opposite second end, said handle having an elongated through slot extending from one end of the handle and extending laterally through said handle, said blade having said second end located within the outer end of said end of said slot, a pivot means coupled to said blade and to said handle to pivotally support said blade, said slot extending from said pivot means for a length slightly greater than the length of said blade, a shield coupled to said pivot unit to pivotally support said shield for pivotal movement relative to said handle and said knife blade, said shield having a thickness substantially corresponding to the thickness of said handle and being pivotally mounted abutting the back edge of said blade opposite said cutting edge, said shield extending outwardly from said pivot unit for a distance in excess of the length of the blade and having a stop portion extending in the opposite direction outwardly of said pivot unit, the stop portion of said shield projecting substantially longitudinally outwardly of said handle with said shield pivoted into abutting engagement with said handle, said shield having an outer smooth surface configuration and including a generally serpentine back edge with the outermost end located adjacent the outer end of the blade flared outwardly from the outer end of said blade to define a smooth deflection surface extending outwardly from the cutting edge and outer tip end of said blade.

* * * * *